US005266994A

United States Patent [19]

Desai et al.

[11] Patent Number: 5,266,994

[45] Date of Patent: Nov. 30, 1993

[54] METHOD AND APPARATUS FOR THE PROCESSING OF A PHOTOSENSITIVE SHEET MATERIAL EMPLOYING A MINIMUM OF LIQUID PROCESSING FLUID

[75] Inventors: Basavaraj R. Desai; Phillip A. Tarbell, both of Knoxville, Tenn.

[73] Assignee: Visicon, Inc., Powell, Tenn.

[21] Appl. No.: 679,762

[22] Filed: Apr. 3, 1991

[51] Int. Cl.[5] ..... G03D 5/00

[52] U.S. Cl. ..... 354/317

[58] Field of Search ..... 354/317, 320, 324, 319, 354/318, 321; 134/122 R, 64 R, 64 P, 122 P

[56] References Cited

U.S. PATENT DOCUMENTS

| | | | |
|---|---|---|---|
| 2,012,604 | 8/1935 | Gillner | 91/14.5 |
| 2,109,647 | 3/1938 | North | 91/18 |
| 2,323,004 | 6/1943 | Baylor | 91/54.4 |
| 2,408,577 | 10/1946 | Pava | 91/32 |
| 3,083,684 | 4/1963 | Carlson | 118/246 |
| 3,363,530 | 1/1968 | Rice | 95/89 |
| 3,574,278 | 4/1971 | Paterson | 68/204 |
| 3,866,566 | 2/1975 | Jones | 118/58 |
| 3,936,918 | 2/1976 | List et al. | 28/59 |
| 3,991,705 | 11/1976 | Adler | 118/7 |
| 4,030,444 | 6/1977 | Collins et al. | 118/257 |
| 4,268,263 | 5/1981 | Meredith | 8/149 |
| 4,327,987 | 5/1982 | Friar et al. | 354/317 |
| 4,332,454 | 6/1982 | Hensel et al. | 354/317 |
| 4,466,993 | 8/1984 | Hsu et al. | 427/44 |
| 4,542,968 | 9/1985 | Knollmann | 354/322 |
| 4,945,934 | 8/1990 | Vaughan, IV | 354/317 X |
| 5,022,418 | 6/1991 | Vaughan, IV | 354/317 X |
| 5,047,795 | 9/1991 | Keable et al. | 354/320 |

FOREIGN PATENT DOCUMENTS

| | | | |
|---|---|---|---|
| 1-114847 | 5/1989 | Japan | 354/319 |

*Primary Examiner*—D. Rutledge

*Attorney, Agent, or Firm*—Luedeka, Hodges, Neely & Graham

[57] ABSTRACT

A method for processing a flexible photosensitive sheet or web material (PSM) including a photographic emulsion on at least one of the flat surfaces thereof and employing a minimum quantity of processing solution including the steps of containing the processing solution in a generally sheet-like geometry, introducing the PSM into the processing solution at a liner face thereof, and substantially immediately upon the entry of the PSM into the processing solution, effecting dispersal of the processing solution onto the emulsion-bearing surface and retaining the solution on such surface for a period of time sufficient to render the surface susceptible to the flow and retention of the processing solution on such surface without external aid. Within the reservoir, the emulsion-bearing surface may be further subjected to one or more further treatments to enhance the development process.

5 Claims, 5 Drawing Sheets

METHOD AND APPARATUS FOR THE PROCESSING OF A PHOTOSENSITIVE SHEET MATERIAL EMPLOYING A MINIMUM OF LIQUID PROCESSING FLUID

This invention relates to the processing of photosensitive sheet or web material of the type comprising a base sheet or web having an emulsion on at least one of the flat surfaces of the base sheet or web. In particular, this invention relates to image development on an exposed photosensitive sheet material employing a minimum of liquid processing solution, such as developer solution.

"Photosensitive sheet material" (PSM) as used herein is intended to include a substantially flexible base sheet or web which carries on at least one of its flat surfaces a coating of a photographic emulsion or the like. Most commonly, the emulsion comprises a plurality of layers, each specifically designed to produce a specific result when the layer is allowed to react with developer solution. Simplistically stated, in the photographic art, reproduction of an image commonly is accomplished by exposing a photosensitive material, for example photographic film or paper, to light reflected from an object or image. The exposed PSM is thereafter "developed" to produce a reproduction, i.e. print, of the image. Development of flexible PSM commonly includes the steps of contacting the exposed PSM with a developer and thereafter subjecting the PSM to other processing steps to bring forth the desired image. Developer solutions comprise combinations of chemicals in aqueous solution, each of the chemicals being chosen to react with one or more of the constituents in one or more of the layers of the emulsion to produce a specific result. For example, the emulsion on a photosensitive material is commonly provided with an outermost protective layer which is relatively tough when dry and is hydrophobic so as to protect the underlying emulsion from physical damage and moisture. In the development process for such a PSM, the developer solution contains a chemical or combination of chemicals which very rapidly reacts with and effectively disables at least the outermost protective layer so that other chemicals in the developer solution can access the underlying layers. In such processing, the physical bringing together of the PSM with the developer is critical with respect to the quality of the resulting print. This is especially true where the process involves generally linear movement of the dry exposed PSM sheet or web into a minimum quantity of developer solution, as opposed to merely submerging the PSM substantially instantaneously into a large volume of developer solution.

The chemical reactions occurring during development of a PSM generate by-products that are taken up in the developer solution which, in turn, renders the developer solution less effective. Further, in the development of the PSM, the emulsion-bearing surface of the PSM may be adversely affected or even destroyed if the emulsion is subjected to inordinate physical forces after the emulsion has been in contact with a developer solution for a period of time sufficient for the outermost layer of the emulsion to react with the developer solution and expose the underlying layers of the emulsion to the developer solution. Brushing is one example of such a disruptive physical force.

In the prior art, it is common to pass the exposed PSM through a tank or vat of developer solution for a time period of residence of the PSM within the solution, and with the solution at a controlled temperature, such that there is adequate opportunity for the developer solution to contact and react with the multi-layered exposed emulsion on the PSM. In such prior art processes, substantial volumes of developing solution are required. These solutions tend to degrade over time, partly due to the chemicals in the solution becoming spent and partly due to the accumulation of by-products in the solution. Degradation occurs, whether the solution is in use or not, and therefore requires that the solution be routinely subjected to tests intended to detect whether the solution is within specific operating parameters. If not, replenishing solution must be added to the tank to bring the solution within such parameters. Such control tests and replenishment techniques require considerable operator skill and attention, hence costs. If the solution cannot be replenished such that it can be brought within the desired limits, it must be completely replaced with fresh solution at substantial cost in time and money.

In the prior art "minimum use" type PSM processing techniques, that is those processing techniques in which there is employed a small, preferably minimum, quantity of developer solution in the course of developing the PSM, as the quantity of developer solution made available to the PSM in the course of its processing is reduced toward the absolute stoichiometric quantity required for developing a particular PSM, there arise problems associated with dispersal of the developer over the surface of the PSM. For example, it is required that the developer reach all the surface area of the emulsion-bearing surface of the PSM, that the developer solution be dispersed uniformly over such surface area, that the developer solution remain in contact with such surface of the PSM during that minimum time required for the reaction of the developer with the emulsion, and that the reactive strength of the developer solution that is in contact with the PSM remain sufficiently strong as permits it to effectively react with the emulsion to the extent necessary for "developing" the image. Importantly, the initial contact of the developer solution with the PSM and all follow-on contact of the solution with the PSM should take place uniformly so that there is substantially uniform time of exposure of all areas of the emulsion-bearing surface of the PSM to the developer, hence uniform development of the image. In the prior art developer-containing vats and the like, such control over the uniformity of exposure of the PSM to the developer solution is very simple, requiring only that the PSM be conveyed through the solution in the vat at a uniform rate of forward movement because there is available at all times a large excess of developer solution within which the PSM is fully immersed. In minimum-use PSM developing systems, however, such luxury of excess developer solution is not available. In particular, the present inventors have found that as the quantity of developer solution is reduced to near that quantity required for stoichiometric reaction with the emulsion on the PSM, new problems arise, such as ensuring that as the PSM is moved initially into contact with the developer solution there occurs uniform physical contact of the developer solution with the emulsion-bearing surface of the PSM. Inasmuch as the PSM is commonly dry at the time it is fed to the developer solution, and in that the protective outermost layer of the emulsion is hydrophobic, the present inventors have found that the PSM tends to reject the developer solution, apparently due to a combination of viscosity, surface tension, hydrophobicity and the like, including even the physical structure of the PSM. This is especially true in view of the fact that in minimum-use devices, there is only a minimum quantity of developer solution available for dispersal onto the PSM. In fact, it has been noted that when the quantity of developer solution is reduced to near the stoichiometric minimum, as one attempts to introduce the leading edge of the PSM into the small quantity of developer solution, the leading edge of the PSM tends to either push the developer solution ahead of or laterally away from the advancing leading edge of the PSM, or if the developer solution does flow over such leading edge and onto the emulsion-bearing surface of the PSM, such flow is not uniform and in many instances the developer solution will flow off the emulsion-bearing surface without reacting therewith so that the result is an incompletely developed PSM. Such rejection of the developer solution by the advancing PSM can occur even when the face of the developer solution into which the PSM is introduced is several times greater in thickness than the thickness of the PSM. For example, a PSM of a thickness of about 0.025 cm, when introduced to a layer of developer solution of as much as 0.6 cm thickness held between two parallel, spaced apart plates, will push the developer solution aside from the advancing PSM, and the PSM will pass through the solution without there being any chemical reaction between the solution and the PSM. Further, in "minimum-use" systems, there can arise problems of ensuring that the emulsion-bearing surface of the PSM continues in constant and full exposure to the developer solution as the PSM is moved forwardly and that the developer solution is of uniform reactive strength through the volume thereof. For example, during the course of development of the PSM it is essential that the emulsion-bearing surface of the PSM at all times be exposed to at least a complete covering of the surface by the developer solution, and preferably that such developer solution be agitated to the extent that relatively depleted solution be replaced with less-depleted developer solution. In a large volume of developer solution, these factors are readily accommodated by stirring and routine addition of developer chemicals to the tank of developer solution. In a "minimum-use" system, stirring as practiced in the prior art is not possible. Further, the addition of developer chemicals per se (as opposed to a completely formulated solution) is also not possible since there is no possibility of thorough mixing of such chemicals with the small volume of developer solution to which the PSM is being exposed. Still further, the addition of a substantial volume of make-up developer chemicals or formulated developer solution, e.g. a liter of make-up solution, to a tank containing 100 liters, for example, represents a 10% addition and such may be sufficient to return the overall volume of developer solution to its full reactive strength. On the other hand, where the total volume of developer solution in use is 100 cc, a 10% addition would be only 10 cc of make-up developer solution. The addition of such a small amount of make-up developer solution presents the aforementioned problem of dispersal of the make-up solution throughout the 100 cc initial volume in a manner that the overall volume of the developer solution remains substantially uniform with respect to its reactive strength. Failure to maintain such uniformity of reactive strength results in non-uniform development of the PSM and an unacceptable print product. A still further potential problem associated with "minimum-use" PSM developing systems is the possibility that the quantity of developer solution available to the PSM falls below that volume which will fully cover the emulsion-bearing surface of the PSM. This situation will also lead to non-uniform development of the PSM.

In U.S. Pat. No. 4,945,934, there is disclosed a PSM processing apparatus employing a relatively small quantity of developer solution wherein the PSM is introduced initially to a relatively excessive volume of developer solution and mechanically forced beneath the surface, i.e., into the body of the solution and held in such submerged relationship for the duration of the development process. In this apparatus, the PSM, while submerged in the developer solution is moved past a stationary screen which serves to aid in distributing developer solution over the emulsion-bearing surface of the PSM and in flowing away reaction by-products. In such process, the agitation of the developer solution, hence the exchange of depleted developer solution at or near the emulsion-bearing surface of the PSM with less-depleted solution is provided by the interaction of the PSM with the solution-laden screen as the PSM is moved relative to such screen. This apparatus and process are effective in producing enhanced print products from exposed PSM. However, careful attention must be paid to effecting initial and uniform exposure of the PSM to the developer solution as the PSM is moved into and through the apparatus.

In accordance with one aspect of the present invention, it has been found that the processing of a flexible exposed PSM may be effected with a minimum quantity of developer solution and obtain a print product that is of equal or enhanced quality relative to the known prior art PSM processing techniques. Such new process comprises containing a relatively small quantity of developer solution such that there is presented to a PSM a linear face of such solution, introducing a leading edge of the PSM to such linear face and before the chemicals in the developer solution have reacted materially with the outermost protective layer of the emulsion, contacting the emulsion-bearing surface with a plurality of flexible fingers that are in contact with developer solution at least at their unattached or distal ends. The fingers are aligned across the direction of forward movement of the PSM into the developer solution and spaced apart from one another by a distance sufficient to at least break down the surface tension of the developer solution, and preferably to draw developer solution into the inter-finger spaces by capillary action. By this means, the developer solution is caused to flow uniformly onto the emulsion-bearing surface of the PSM as it moves into the developer solution initially and to be retained on such surface by the fingers for a time period sufficient to permit the developer solution to react sufficiently with the outermost protective layer of the emulsion as causes the developer solution to thereafter flow onto the emulsion-bearing surface unaided by external physical forces. Importantly, the area of contact between the fingers and the emulsion-bearing surface of the PSM is maintained at a minimum and preferably comprises a plurality of substantially tangential areas of contact that define a single line of such contacts across the direction of forward movement of the PSM into the developer solution. The mounting of the fingers is chosen such that the leading edge of the PSM contacts the fingers and deflects them downstream such that as the PSM moves under the deflected fingers, there is substantially tangential contact between the PSM and the fingers. In any event, the contact of the fingers with the emulsion-bearing surface of the PSM preferably does not continue substantially past that point where the outermost protective layer of the emulsion has reacted with the developer solution to the extent that such layer is no longer an effective barrier to access to the underlying layers of the emulsion by the developer solution.

In accordance with another feature of the present invention, after a brief time period following the rendering of the outermost protective layer of the emulsion ineffective and during which at least the initial chemical reaction(s) between the developer solution and the underlying layer(s) of the emulsion have commenced and are partially completed, essentially all liquid on the surface of the emulsion is removed from the emulsion-bearing surface of the PSM, and immediately thereafter, there is introduced to the emulsion-bearing surface a quantity of relatively less-depleted developer solution. The PSM is thereafter continued in contact with the developer solution for a period of time sufficient to effect the desired extent of reaction of the exposed portions of the emulsion with the developer solution as brings about the desired print product.

In a preferred embodiment, the substantial removal of the developer solution from the surface of the emulsion-coated surface of the PSM is effected by means of a yieldable blade which has the ability to conform to the surface of the PSM to the degree that the contact therebetween prevents any material passage of developer solution past the blade so that such solution is effectively wiped from the surface of the PSM. In accordance with the present invention, further, and fresh, i.e. relatively less-depleted developer solution is provided on the downstream side of the blade so that substantially immediately following removal of the relatively depleted solution from the surface of the PSM, and without that portion of the PSM from which the developer solution has been removed being materially subjected to an environment other than the developer solution, there is deposited on the same emulsion-bearing surface such fresh developer solution. It has been found that such relatively complete removal of the relatively depleted developer solution, along with the reaction by-products contained therein, and substantially immediately thereafter replacing such depleted solution with less-depleted solution appears to ensure that the by-products of the reaction of the developer solution and the outermost protective layer of the emulsion are removed from the immediate vicinity of the emulsion surface and the underlying layers of the emulsion are better exposed for development. Whereas the exact action taking place during this initial removal and replacement of the developer solution is not known, one skilled in the art would expect that removal and subsequent replacement of the developer solution would adversely affect the continuity of the development process and/or the physical contact between the blade and the emulsion would damage the emulsion. Neither event occurs in the practice of the present invention.

In accordance with a further aspect of the present invention, the inventors provide apparatus for physical confinement of the developer solution in a generally planar, and preferably horizontal, attitude and defining a linear face of developer solution which is exposed for receipt of the PSM. As the PSM is fed to the developer solution, the leading edge of the PSM initially contacts such linear face. In a preferred embodiment of the apparatus, the containment vessel is formed of top and bottom members that mate in overlying relationship and define therebetween a reservoir for receiving the developer solution. Parallel spaced apart elements of the top and bottom members define a front elongated opening into which the PSM is received. The liner face of the developer solution is defined by such opening. The vertical thickness of such elongated opening is not materially greater than the thickness of the PSM. By reason of such relatively close spacing of the physical containment surfaces for the developer solution, the hydrophobicity of the outermost protective layer of the emulsion, and the surface tension of the developer solution, the developer solution tends to be pushed ahead of and/or to the side of the advancing leading edge of the PSM such that the PSM is deprived of developer solution on the emulsion-bearing surface thereof. In the present apparatus, however, there is provided a linear arrangement of flexible fingers, such fingers being aligned in side-by-side relationship and extending substantially fully across the direction of forward movement of the PSM into the developer solution. The lateral spacing of the fingers is sufficient to at least break down the surface tension of the developer solution, and preferably to draw developer solution into the inter-finger spaces by capillary action. By this means, the developer solution is caused to flow onto the emulsion-bearing surface of the PSM as it moves into the developer solution initially and to be retained on such surface by the fingers for a time period sufficient to permit the developer solution to react sufficiently with the outermost protective layer of the emulsion and alter the emulsion such that the developer solution thereafter will flow onto and remain on the emulsion-bearing surface unaided by external physical forces.

Also as noted above, the apparatus includes a yieldable blade which extends substantially fully across the direction of forward movement of the PSM through the developer solution and which is mounted such that the unattached edge of the blade has the ability to conform to the surface of the PSM as the PSM moves beneath the blade and to wipe from the emulsion substantially all developer solution. To this end, the blade is inclined in a direction downstream of the movement of the PSM so that there is only tangential contact between the PSM and the blade, such contact extending linearly across the direction of forward movement of the PSM. Such extended linear contact of the blade tangentially with the PSM appears to distribute the pressure exerted by the blade against the PSM over a sufficiently large collective area as prevents the blade from damaging the emulsion. If desired, additional such blades may be positioned downstream of the first blade, each such additional blade being substantially identical in construction and functioning in like manner to the functioning of the first blade.

In another feature of the present apparatus, there is provided downstream of the first blade one or more elongated woven fabric loops, each such loop comprising a generally "U"-shaped cross-section of woven fabric. The legs of the loop are secured to the upper part of the containment vessel such that the bight of the loop extends downwardly into the reservoir of the containment vessel and with the loop being inclined rearwardly of the direction of forward movement of the PSM through the reservoir. Preferably the bight of each loop is of a length such that the inclined bight of each loop projects downstream sufficiently to resiliently contact and bear against its adjacent downstream loop, thereby developing a spring-type action which serves to maintain the loops in contact with a PSM moving therepast. Each loop extends substantially fully across the direction of forward movement of the PSM and is substantially immersed in developer solution contained within the reservoir. In this manner, each loop with developer solution contained within the interstices of the woven strands that make up the fabric, is caused to resiliently remain in contact with the emulsion-bearing surface of the PSM as the PSM moves through the reservoir, thereby enhancing the delivery of developer solution to the emulsion and the removal of relatively depleted developer solution from the emulsion and replacement thereof with relatively less-depleted developer solution.

Accordingly, it is an object of the present invention to provide an improved method for the processing of PSM sheet or web.

It is another object of the present invention to provide such an improved method in which there is employed a minimum quantity of processing solution at least in the developing stage of such PSM.

It is another object of the present invention to provide an improved apparatus for the processing of PSM.

Stated briefly, in accordance with the method of the present invention, there is provided a relatively small quantity of developer solution contained such as to present a linear face of developer solution. The leading edge of a sheet or web of PSM which has been exposed is introduced to the linear face of developer solution. Before the chemicals of the developer solution have reacted materially with the outermost protective layer of the emulsion, the PSM is contacted by a plurality of flexible fingers disposed substantially fully across the direction of forward movement of the PSM and whose unattached ends, at least, are in fluid communication with the developer solution. The fingers are oriented in side-by-side relationship and are spaced apart by a distance not greater than that distance which allows the fingers to disrupt the surface tension of the developer solution sufficiently as causes the developer solution to flow over and into contact with the emulsion-bearing surface of the PSM and/or preferably to convey developer solution into the inter-finger spaces by capillary action. The angle of contact of the fingers with the emulsion-bearing surface of the PSM is less than 90 degrees so that there is reduced tendency of the fingers to physically disrupt the emulsion. Further, the collective area of contact between the fingers and the emulsion is purposely minimized and preferably is restricted to a narrow linear area defined by a plurality of substantially tangential individual contacts between the fingers and the emulsion. This collective linear area of contacts extends substantially fully across the forward direction of movement of the PSM through the developer solution. Further, such collective area of contact preferably is commenced substantially immediately upon the PSM initially contacting the developer solution and in any event is ended prior to there being material access of the developer solution to those layers of the emulsion that underlie the outermost protective layer. In this manner, the fingers are in contact with the emulsion-bearing surface of the PSM only during that time prior to which the developer solution has reacted with the outermost protective layer of the emulsion to the extent that the fingers could effect disruption or damage to the underlying layer(s) of the emulsion. Brief though such time period be, the present inventors have found that the disruption of the surface tension forces between the developer solution and the emulsion-bearing surface of the PSM need only be maintained for that brief time, e.g. a few seconds, required for the developer solution to react with the outermost protective layer of the emulsion to the extent that the developer solution will thereafter flow onto the wetted emulsion unaided by external physical forces such as the fingers. Also importantly, it is not desired that the contact between the fingers and the emulsion continue past the point where the protective coating layer has been rendered ineffective by the developer solution. By breaking off the contact of the fingers with the emulsion at or near such point, there is no opportunity for the fingers to adversely affect the processing of the underlying layer(s) of the emulsion or cause physical disruption or damage to such layer(s).

As described hereinabove, after the outermost protective layer of the emulsion has been rendered ineffective and the emulsion-bearing surface becomes hydrophilic, the developer solution diffuses into contact with the underlying layer(s) of the emulsion and commences reacting therewith as the development process continues. As also noted above, in accordance with the present method, the emulsion-bearing surface of the PSM which is initially thoroughly wetted by the developer solution and whose outermost protective layer has been rendered ineffective is caused to remain in contact with the developer solution and therefore react with the exposed underlying layer(s) of the emulsion for a time sufficient for partial completion of the developer-emulsion reaction. This portion of the developer-emulsion reaction proceeds quite rapidly, commonly taking place in less than about 6 to 10 seconds, but will vary depending upon several factors such as the type of emulsion, etc. Thereafter, in the preferred embodiment, the developer solution on the emulsion-bearing surface, plus the reaction by-products associated therewith, are substantially all removed from such surface thereby leaving a substantially developer solution-free surface. Almost immediately thereafter, further, and preferably less-depleted, developer solution is brought into contact with the emulsion-bearing surface. This fresh developer solution thereupon commences reacting with the theretofore "cleaned" emulsion-bearing surface and such reaction is allowed to continue to the desired degree of completion. Following treatment of the PSM with developer solution, the PSM may be further treated by any of several further steps that include water washing, color developing, bleaching, fixing, etc. As desired, the apparatus of the present invention may be employed also in one or more of such subsequent PSM treatment steps, such as in the color development step.

In accordance with the apparatus of the present invention, the inventors provide means for containing a selected small quantity of developer solution in position to initially contact the advancing PSM and to ensure uniform initial and continuing contact between the PSM and relatively less-depleted developer solution over that period of time required for the developer solution and emulsion on the PSM to react and develop the PSM. The quantity of developer solution made available to the emulsion-bearing surface of the PSM is selected to be as near to the stoichiometric quantity required for developing the PSM as is practical. To this end, the apparatus comprises a processing solution containment vessel including housing means defining a generally planar passageway including a reservoir which is provided with developer solution and through which the PSM is caused to move. Such reservoir has an internal cavity preferably is of a generally rectangular geometry in plan view and in cross section, so that the developer solution contained therein and which assumes the form of the cavity has a depth that is several times less than either the width or the length of the body of developer solution. That is, the reservoir is designed to maintain the developer solution in the form of a substantially sheet-like body. Means is provided to feed developer solution from a source thereof to the reservoir with such solution being received in a manifold means extending preferably along that edge of the reservoir (referred to herein as the front edge) into which the PSM is first admitted so as to provide a constantly-available flow of developer solution therein. The housing is further provided with channels or the like so that at all times during use, the reservoir defined by the housing is supplied with developer solution that is available for flow throughout the reservoir. The leading edge of the PSM is fed forwardly into the open front edge of the reservoir and exits the open rear edge of the reservoir.

Within the reservoir there is mounted the array of flexible fingers referred to hereinabove and which are disposed substantially fully across the direction of forward movement of the PSM and whose unattached ends, at least, are in fluid communication with the developer solution. The fingers are oriented in side-by-side relationship and are spaced apart by a distance not greater than that distance which allows the fingers to disrupt the surface tension of the developer solution sufficiently as causes the developer solution to flow over and into contact with the emulsion-bearing surface of the PSM and/or preferably to convey developer solution into the inter-finger spaces by capillary action.

In one embodiment, there is also mounted within the reservoir a conformable solid blade member that extends along substantially the full length dimension of the reservoir and therefore across the direction of forward movement of the PSM. This blade is inclined rearwardly of the direction of forward movement of the PSM and is biased toward that wall portion of the reservoir opposite the wall portion to which the blade is mounted, e.g. the blade is mounted in the top wall of the housing and is biased toward the bottom wall of the housing. The blade means of the present invention preferably is inherently resilient or is resiliently mounted with respect to the PSM. By reason of the conformability of the blade and the fact that it is biased toward the PSM as the PSM moves under the blade, it is assured that there is full linear contact between the blade and the PSM. In this manner, any sheet material (PSM) passing through the reservoir is contacted by the blade and the blade wipes from the PSM essentially all developer solution which has been deposited onto that surface of the PSM which is contacted by the blade. The blade is immersed in the developer solution and is inclined in the direction of PSM movement so that immediately after the surface of the PSM is wiped clean of developer solution, further and less-depleted developer solution from the reservoir substantially immediately flows into contact with the wiped surface of the PSM.

In one embodiment of the present apparatus, planar flexible screen means having rectangular dimensions slightly less than the like dimensions of the reservoir is mounted along one of its long side edges to the interior wall of the reservoir immediately downstream of the blade such that the screen means overlies and floats into contact with the PSM as it moves through the reservoir after passing the blade. The screen means is provided with a plurality of passageways that are connected one to another in fluid communication and which define individual small pockets that extend through the thickness of the screen and provide flow channels through such screen thickness and flow between adjacent pockets. Developer solution is also supplied to the screen means is held within the individual pockets and is dispersed over, and into contact with, substantially the entire emulsion-bearing surface of the PSM. Further, the screen means includes on at least that surface thereof facing the PSM a plurality of spaced apart protrusions which contact the emulsion-bearing surface of the PSM and which serve to wipe individually small areas of such surface to aid in the removal of spent developer solution from such areas, to aid in micro-agitation of the developer solution and thereby allow less-depleted developer solution to flow into contact with the emulsion-bearing surface. The screen is preferably unattached except along that side edge thereof which is mounted to the reservoir wall. One such screen is described in U.S. Pat. No. 4,945,934 which is incorporated herein by reference.

In another feature of the present apparatus, in lieu of the aforementioned planar floating screen, there is provided downstream of the first blade one or more elongated woven fabric loops, each such loop, in cross section, comprising a generally "U"-shaped section of woven fabric. The legs of the loop are secured to the upper part of the containment vessel such that the bight of the loop extends downwardly into the reservoir of the containment vessel and with the loop being inclined rearwardly of the direction of forward movement of the PSM through the reservoir. As noted hereinabove, preferably the bight of each loop is of a length such that the inclined bight of each loop projects downstream sufficiently to resiliently bear against its adjacent downstream loop, thereby developing a spring-type action which serves to maintain the loops in contact with a PSM moving there-past. Each loop extends substantially fully across the direction of forward movement of the PSM and is substantially immersed in developer solution contained within the reservoir. In this manner, each loop with developer solution contained within the interstices of the woven strands that make up the woven fabric, is caused to resiliently remain in contact with the emulsion-bearing surface of the PSM as the PSM moves through the reservoir, thereby enhancing the availability of developer solution to the emulsion and the removal of relatively depleted developer solution from the emulsion and replacement thereof with relatively less-depleted developer solution.

The following is a brief description of the drawings accompanying this application:

Figure 1:
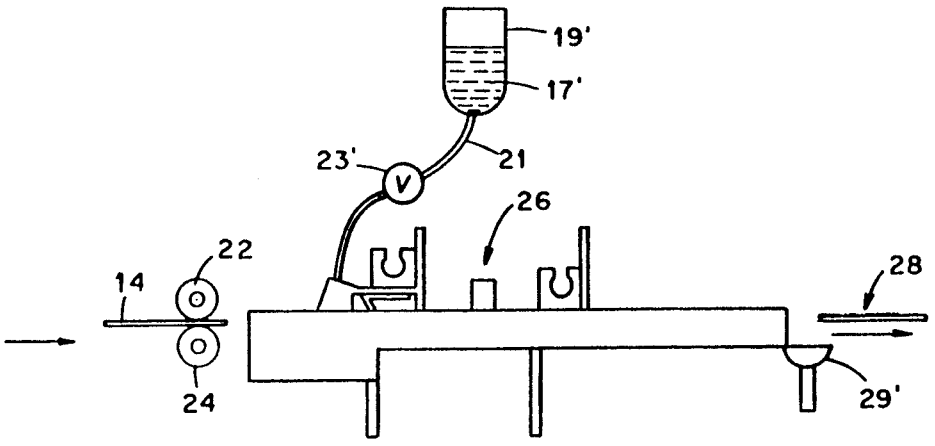
FIG. 1 is a representation of a system for processing a PSM and embodying various features of the present invention.
Figure 1:
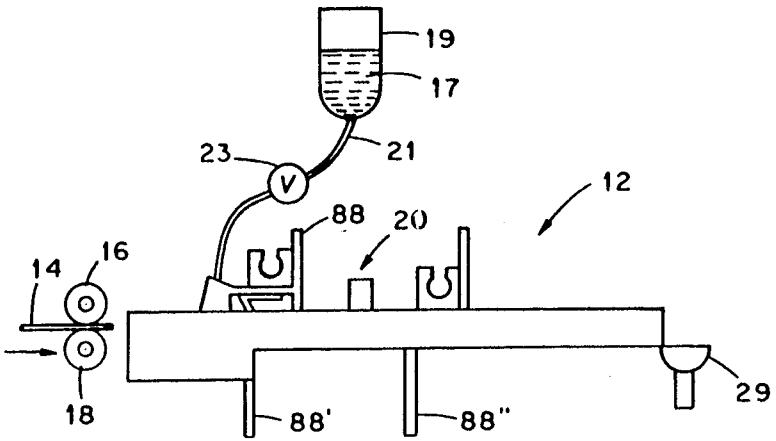

Referring now to the Figures, in FIG. 1 there is depicted a system 12 for processing a PSM employing various features of the present method and apparatus. In the depicted embodiment, a PSM 14 is fed forwardly (see arrows) preferably at a constant rate of movement, through a set of feed rolls 16 and 18 to a first station indicated generally by the arrow 20 at which the PSM is treated with developer solution. Thereafter, the PSM is moved forwardly as by feed rolls 22 and 24 to a further station 26 at which the PSM is further treated as by a fixing solution, a wash solution or other processing solution. Whereas two stations are depicted in the system of FIG. 1, it will be recognized that other and additional stations may be employed. Eventually the PSM exits the solution as a developed product which is indicated generally at 28. The present system is designed to utilize a minimum quantity of processing solution through maximum manipulation of such processing solution. Any excess or overflow of processing solution is captured in an overflow tray 29 for subsequent disposal. The system of FIG. 1 necessarily is depicted schematically and it is to be recognized that a complete system includes elements that are not depicted, such as mounting means, housings, controls and the like may be supplied readily by one skilled in the art. At each station, liquid processing solution, e.g. developer solution, etc., contained in a vessel 19 is fed, as by gravity, through a conduit 21 to each station. Control of the flow from the vessel to the station may be by means of a conventional valve 23.

Figure 2:
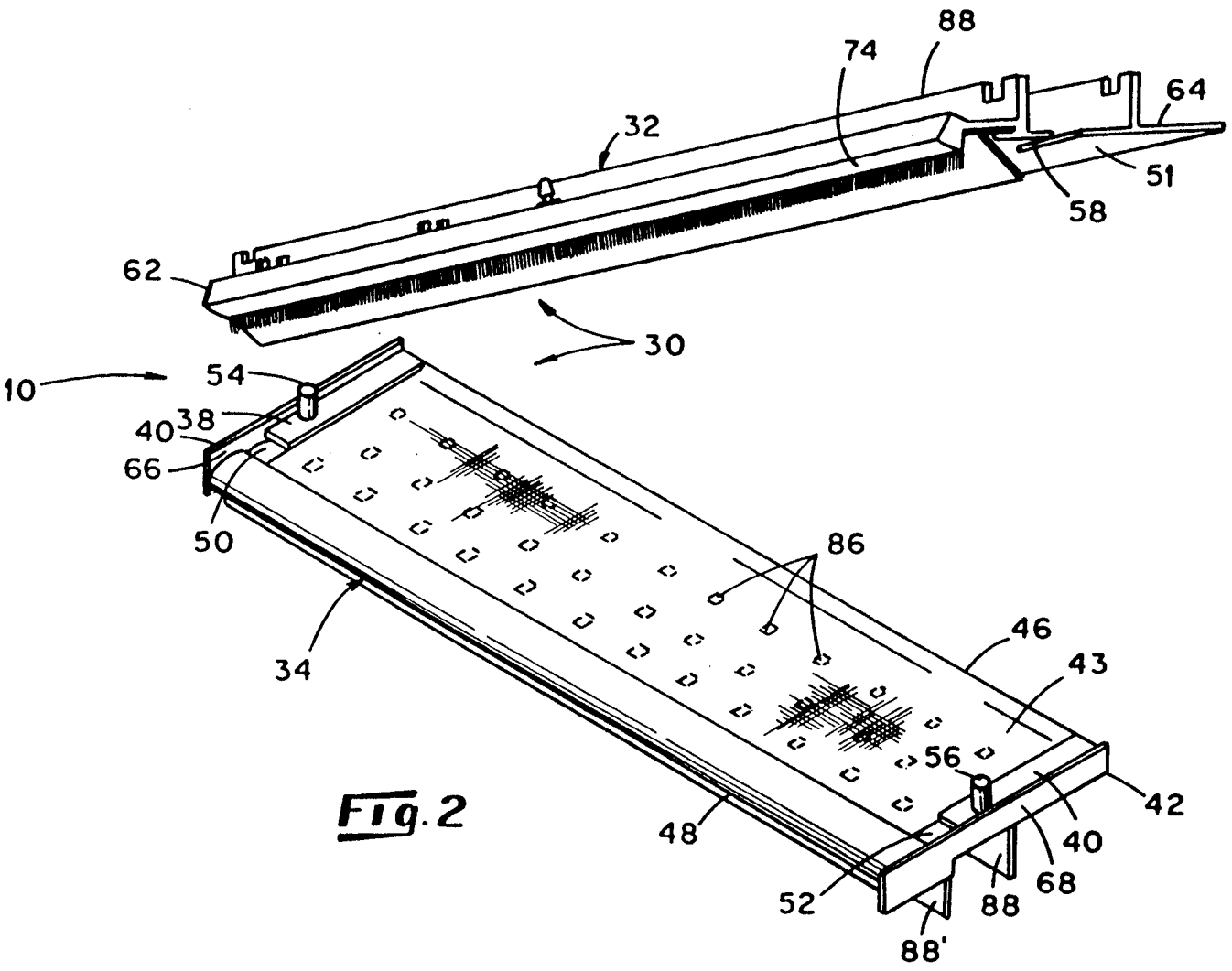
FIG. 2 is a representation, in perspective and partially of a containment vessel and embodying various features of the invention.
Figure 9:
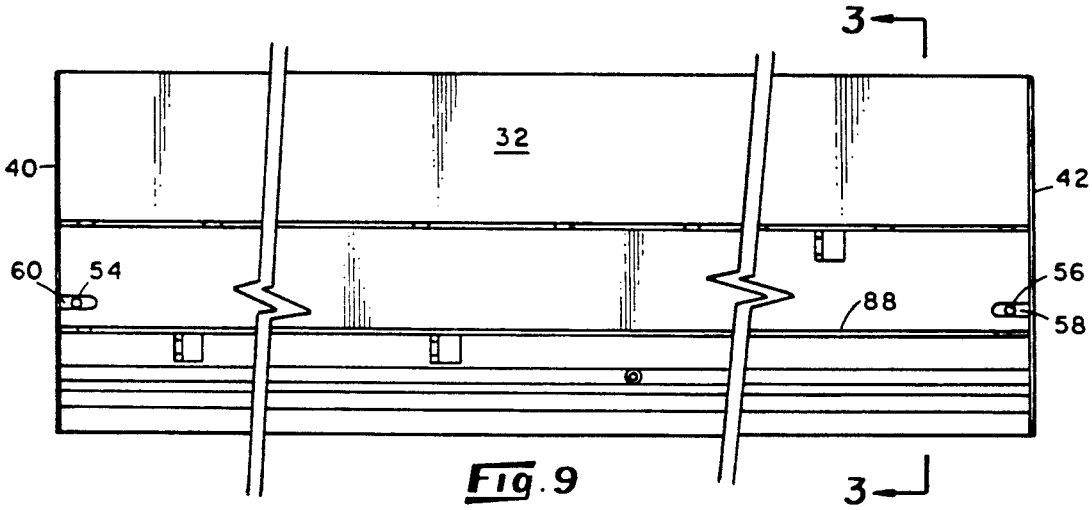
FIG. 9 is a plan view of a processing solution containment vessel and embodying various features of the invention; and, FIG. 10 is a front elevational view of the containment vessel depicted in FIG. 9.
Figure 10:
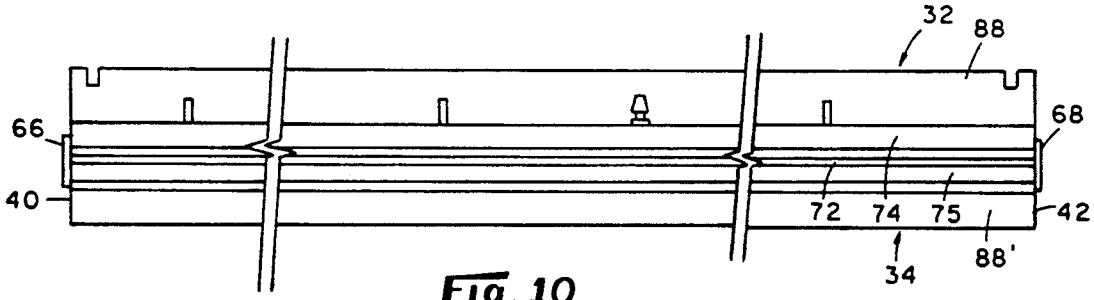

In FIG. 2 there is depicted one embodiment of a containment vessel 10 for carrying out the method of the present invention. The depicted apparatus comprises a housing means 30 including top and bottom generally rectangular housing sections 32 and 34, respectively (see also FIG. 3). These top and bottom sections 32 and 34 are designed to cooperatively mate, with the top section overlying the bottom section and being spaced therefrom to define therebetween a liquid reservoir 36. Referring specifically to FIG. 2, each of the top and bottom sections of the housing is self-supporting and the vertical spacing between the same is established by the thickness of shoulders 38 and 40 provided at each of the opposite ends 42 and 44 of the bottom housing section 34 and projecting upwardly from the upwardly facing inner surface 43 of the bottom housing section 34. Each of the shoulders extends from the rear edge 46 of the bottom housing section toward the forward edge 48 of such bottom housing section, but terminates short of such forward edge to define fluid flow channels 50 and 52, respectively, when the top and bottom housing sections are disposed in overlying relationship and with the downwardly facing inner surface 51 of the top housing section 32 in contact with such shoulders. Alignment of the top and bottom housing sections is achieved in the depicted embodiment by means of upstanding lugs 54 and 56 mounted to the shoulders 38 and 40 and received in appropriate slots 58 and 60 provided adjacent the opposite ends 62 and 64 of the top housing section 32 (see also FIGS. 9 and 10).

Figure 3:
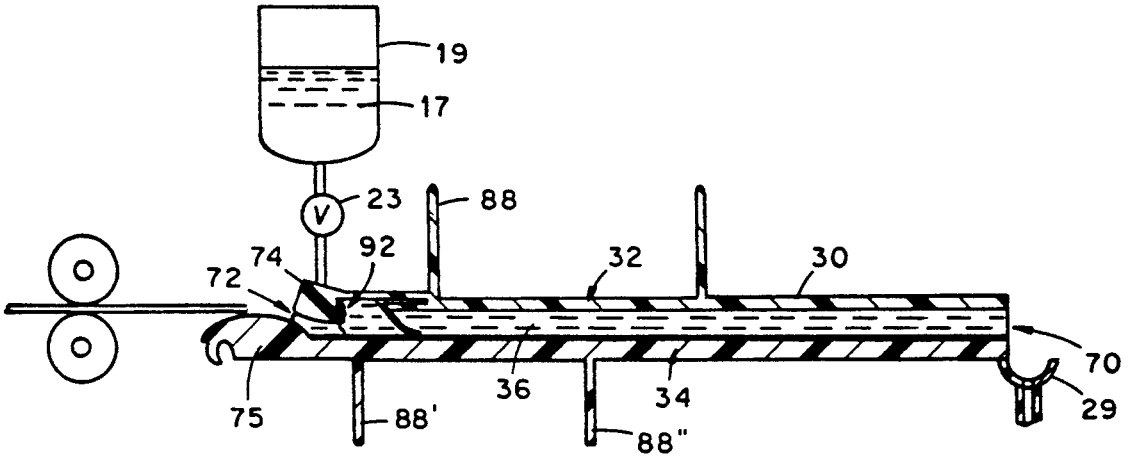
FIG. 3 is a sectional view taken along the line 3—3 of FIG. 9 and depicting details of a portion of one embodiment of the present invention.
Figure 4:
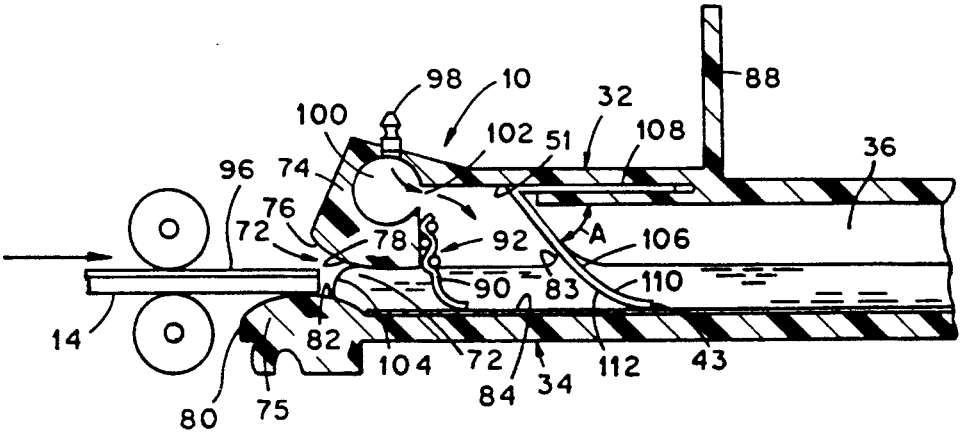
FIG. 4 is a fragmentary and enlarged sectional view of a cut-away portion of a further embodiment of the apparatus of the present invention and depicting an array of fingers and a blade disposed within the liquid-containing reservoir.

As noted, when the top and bottom housing sections 32 and 34 when the same are disposed in overlying relationship as depicted in FIGS. 3 and 4, there is defined therebetween an elongated reservoir 36 (see also FIG. 2) which is of generally rectangular geometry and which has a thickness that is many times less than either the length or width of the same. The ends of the reservoir are closed as by end panels 66 and 68 provided on the opposite ends 40 and 42 of the bottom housing section 34. The rear side edge of the reservoir indicated generally at 70 is open. In accordance with the present invention, the forward edge of the reservoir indicated generally at 72 is defined by an enlarged elongated strip 74 that extends fully across the width dimension of the top housing section, i.e. fully between the side edges 62 and 64 of the top housing section, and by a further elongated strip 75 that extends across the width dimension of the bottom housing section, and parallel to the strip 74. The exposed surface 76 of the strip 74, in cross section, is convexly arcuate and when the top and bottom housing sections are disposed in overlying relationship, such surface 76 projects downwardly into the reservoir near the forward edge of the reservoir and defines an upper lip 78. The strip 75 is similarly convexly arcuate in cross section to define a convexly arcuate surface 80 which projects upwardly into the reservoir and defines a lower lip 82 which is parallel to the upper lip 78. By choice of the vertical spacing between the top and bottom housing sections, the vertical spacing between the upper and lower lips 78 and 82 may be selected to provide a desired linear opening between such lips through which the PSM 14 is received. As best seen in FIG. 3, the relative positions of the arcuate surfaces 76 and 80 of the strips 74 and 75 are selected such that the lip 78 of the top housing section 32 is disposed rearwardly (more inwardly of the reservoir) than the associated lip of the bottom housing section 34. Further, the lip 82 of the lower strip 75 is disposed at a higher elevation than the inner surface 43 of the bottom housing section 34 to aid in preventing the flow of liquid developer solution from the reservoir through the spacing between the lips 78 and 82. Further, such outward flow of the developer solution is inhibited by the vertical spacing between the lips which is selected such that the surface tension of the developer solution effectively prevents such outwardly flow.

The upwardly facing inner surface 43 of the bottom housing section 34 is provided with a woven fabric or screen 84 or the like over substantially its entire surface area. Preferably such woven fabric is anchored to the surface 43 at spaced locations 86 thereby ensuring that the woven fabric remains in place when a PSM is moving thereover. This woven fabric serves to disrupt any tendency of the flat surface of the PSM, when wetted, to adhere to the inner surface 43 due to the attractive forces exerted by a thin film of liquid therebetween.

In the embodiments of the several Figures, there are depicted several elongated panels or ribs 88 which serve variously for mounting of the containment vessel 10 within other superstructure and/or for strengthening purposes.

Figure 5:
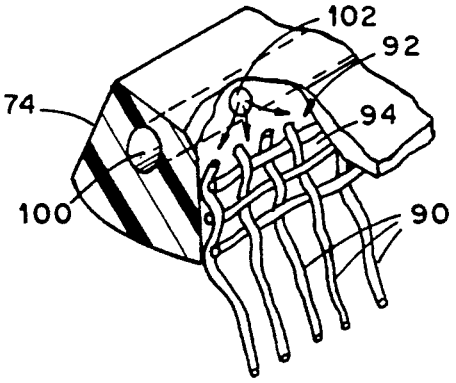
FIG. 5 is a fragmentary enlarged representation showing one embodiment of a finger array as depicted also in FIG. 4.
Figure 6:
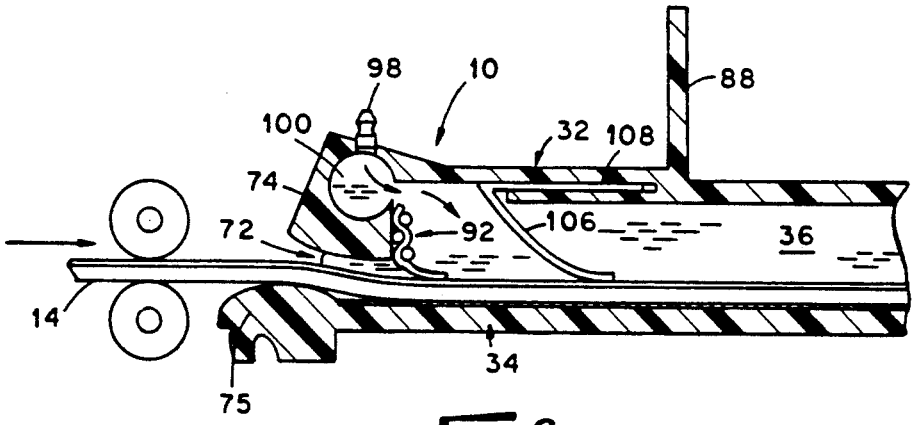
FIG. 6 is a sectional view as in FIG. 4 and depicting a PSM within the liquid-containing reservoir and as contacted by the finger array and the blade.

Referring specifically to FIGS. 4 and 5, within the reservoir 36 there is mounted a plurality of resilient fingers 90 that are aligned in side-by-side relationship and which extend substantially fully across that dimension of the reservoir which is normal to the direction of movement of the PSM through the reservoir. In the depicted embodiment, the fingers 90 each comprise a strand of a woven fabric 92. As best seen in FIG. 5, an elongated section of woven fabric is secured to the rear side 94 of the upper strip 74 with a portion thereof depending from such strip and into the developer solution contained within the reservoir. The weft strands of that portion of the woven fabric which depends from the strip 74 are removed leaving a length of each warp strand of the fabric depending from the strip, each such dependent length of warp strand defining a finger 90. The depicted fingers are creped due to the set which was imparted to the woven strand during and following weaving of the same, but it is recognized that non-creped or straight fingers are acceptable. The lateral spacing between individual fingers is chosen to be sufficient to break down the surface tension of the developer solution as the PSM moves into the developer solution, contacts the fingers, and deflects the fingers rearwardly. The depicted fingers are inherently resilient. In any event, the fingers should be biased into contact with the emulsion-bearing surface 96 of the PSM moving past the fingers to the extent that the surface tension of the developer solution is broken down and the solution is retained in contact with the outermost protective coating of the PSM for a time period sufficient to permit the developer solution to react with such outermost protective coating sufficiently to render the emulsion-bearing surface hydrophilic whereupon the developer solution will thereafter flow onto the emulsion-bearing surface without the aid of external physical forces. To this end, a lateral spacing of less than about ¼ inch has been found suitable. The minimum spacing between the fingers is not critical and the fingers may actually randomly touch adjacent fingers so long as the fingers flex independently of one another and are not impeded with respect to their flexibility. The unsupported lengths of the several fingers and the degree of flexibility of each finger preferably are uniform so as to ensure uniform engagement of the several fingers with the PSM moving therepast. One suitable woven fabric for use in forming the array of fingers is woven fabric made of polyester monofilaments such as that available from Saati of Milano, Italy under the trademark Saatilene. One particularly suitable woven fabric is the Saatilene polyester fabric having 61 strands per inch woven in a square weave, and with each strand having a diameter of 120 microns. Preferably sufficient weft strands are removed from the woven fabric as provides at least about ¼ inch of unsupported length of each warp strand, and preferably about ⅜ inch of such unsupported length. Longer lengths may be employed, but in any event, the length of the fingers is to be chosen such that the distal ends of the fingers end their contact with the PSM after there has occurred sufficient reaction of the developer solution with the emulsion as renders the emulsion hydrophilic, but are not in contact with the PSM after that time at which the outermost protective coating is broken down to the extent that the exposed underlying layers of the emulsion are exposed to physical damage by the fingers. These time periods will vary with different PSMs and/or different developer solution chemistry but are well understood by those skilled in the art.

As noted, the preferred array of fingers comprises a single line of fingers mounted in side-by-side relationship and extending across the reservoir in a direction normal to the movement of the PSM through the reservoir. Multiple lines of such fingers may also be employed, but in any event, the flexibility of the individual fingers must not be increased by reason of the support imparted thereto by adjacent fingers to the point where the fingers are sufficiently inflexible as causes them to disrupt or damage the emulsion on the surface of the PSM. Multiple lines of fingers have been found unnecessary and preferably are not employed due to their tendency to damage the emulsion.

In FIG. 4, there is depicted a portion of a containment vessel 10 including top and bottom housing sections 32 and 34, respectively, which cooperatively define therebetween a reservoir 36. As previously discussed hereinabove, liquid processing solution, e.g. developer solution, is fed as needed to the reservoir through an inlet port 98 which is in fluid communication with a manifold 100 that extends across the lateral dimension of the containment vessel. This manifold is also in fluid communication with the reservoir via openings 102 spaced along the length of the manifold (only one opening is shown) so that the reservoir has available to it at all times sufficient developer solution to maintain at least a covering layer of developer solution over the emulsion-bearing surface of the PSM. Outflow of the developer solution through the leading edge 72 thereof when a PSM is not being processed is prevented by the vertical spacing of the lips 78 and 82 as indicated by the meniscus 104 depicted in FIG. 4. Outflow of developer solution through the open rear edge of the reservoir is inhibited by a dam provided along the rear edge of the bottom housing section 34 and by the limited vertical spacing between the rear edges of the top and bottom housing section which in combination with the surface tension of the developer solution serves to restrict outflow. As further depicted in FIG. 4, within the reservoir there is mounted to the inner surface 51 of the top housing section 32 a blade 106. This blade is solid and may be inherently resilient or resiliently mounted. As depicted, the blade is inclined rearwardly with respect to the direction of travel of the PSM through the reservoir at an angle "A" of less than 90 degrees and preferably at an angle of about 15 degrees with respect to such direction of movement of the PSM. One particularly suitable blade may be fabricated from a polyester sheet of 0.005 inch thickness available from Teledyne Post of Chicago, Ill. under catalog number 18U5, double mat surface, formed into a generally "V" shaped cross section. One leg 108 of the blade is mounted to the inner surface of the top housing section and the other leg 110 depends into the reservoir, and preferably is of a length greater than the vertical depth of the reservoir so that the lowermost edge 112 of the leg 110 terminates at a location substantially downstream of the mounting location of the blade to the top housing section thereby ensuring that the blade is in substantially tangential engagement with a PSM moving therepast. The location of the blade 106 within the reservoir is chosen to be rearwardly of the entrance of the PSM into the developer solution by a distance such that at the rate of forward travel of the PSM, the blade contacts the PSM after the outermost protective layer of the emulsion has reacted with the developer solution to the extent that such layer has been substantially and preferably completely rendered ineffective as a barrier to access to the underlying layers of the emulsion by the developer solution. In a preferred embodiment, the blade 106 is located downstream such that there has been no substantial reaction of the developer solution with the underlying layers of the emulsion prior to engagement of the blade with the PSM.

Figure 7:
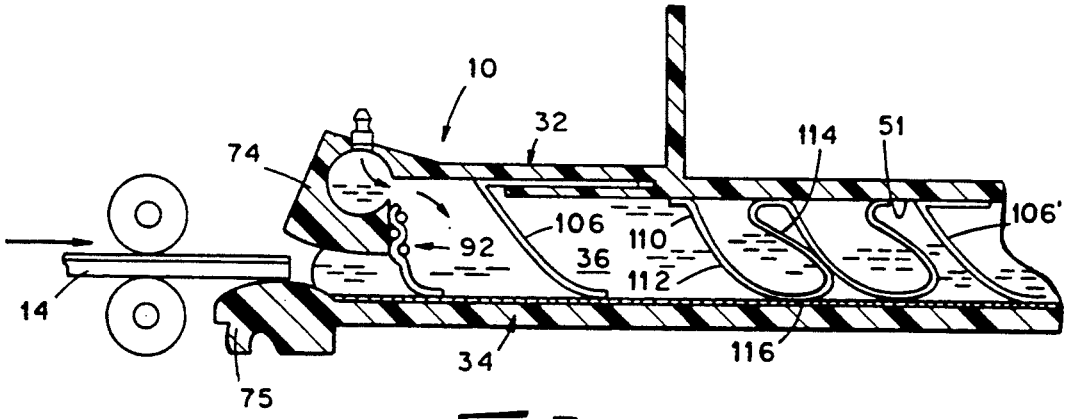
FIG. 7 is a sectional view as in FIG. 4 and depicting a still further embodiment including multiple blades and loop means disposed with the reservoir.
Figure 8:
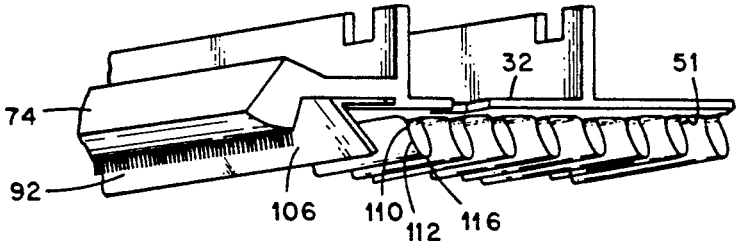
FIG. 8 is a fragmentary representation of one embodiment of a top housing section and depicting a still further embodiment including a plurality of elongated loops secured to such top housing section.

As the PSM is moved forwardly through the reservoir, its leading edge contacts the blade 106 and deflects the same rear-wardly as the PSM continues to move past the blade. The blade thus serves to wipe from the PSM substantially all liquid, e.g. in the nature of a squeeging action. This action serves to remove from the emulsion-bearing surface of the PSM spent developer solution and by-products from the breakdown of the outer protective layer and thereby more effectively expose the underlying layers of the emulsion. Inasmuch as the blade is immersed in the developer solution, on the downstream side of the blade there is available relatively less-depleted developer solution to flow immediately into contact with such underlying layers of the emulsion to enhance the development reaction(s) and reduce the quantity of developer solution required to complete the development process. As depicted in FIG. 7, further and additional blades 106' may be provided at locations downstream of the first blade 106 to repeat the liquid removal-replacement function.

In accordance with another feature of the present invention, there is provided within the reservoir 36 a plurality of elongated woven fabric loops 110. Each loop comprises an elongated section of a woven fabric, for example, which is formed into a generally "U" shaped geometry, in cross section. The legs 112 and 114 of each loop are secured to the upper surface 51 of the top housing section 32 so that the bight 116 of each loop depends downwardly into the reservoir and is immersed in the developer solution contained within the reservoir. Each elongated loop extends across the lateral dimension of the containment vessel and normal to the direction of the movement of the PSM through the reservoir. Preferably each loop is inclined, e.g., about 15 degrees, rearwardly with respect to the direction of movement of the PSM and where multiple loops are employed, the bight of each loop extends rearwardly to contact the bight of its adjacent downstream loop to thereby develop a spring-type action that serves to urge the loops against a PSM moving therepast. As the PSM moves past each loop, the loop rides upon the emulsion-bearing surface of the PSM and functions to both agitate the solution on such surface and to promote the flow of spent developer solution from such surface and the flow of less-depleted developer solution onto the surface of the emulsion which enhances the speed of the development reaction and aids in minimizing the quantity of developer solution required for the development of a given PSM. One suitable fabric from which the loops may be fabricated is available from Saati of Milano, Italy under the trademark Saatitex and comprises a woven polyester fabric of a square weave having 77 multifilamentary strands per inch and a mesh count of 196. In this woven fabric, the mesh opening is 69 microns, its thickness is 83 microns and a weight of 42 $gm/m^2$. Whereas a woven fabric formed from monofilamentary strands may be used in the present apparatus, the multifilamentary strands appears to be less abrasive to the emulsion and more effective in its function of dispersing and conveying developer solution to and from the emulsion. The length of the bight of each loop is chosen such that the the loop is engaged and deflected by the moving PSM, the contact between the bight and the PSM is generally tangential with respect to the curved bight, and the loop rides gently over the emulsion-bearing surface of the PSM.

In a typical operation employing the method and apparatus of the present invention, an Ektachrome copy paper (PSM) from Eastman Kodak having a length of 20 cm (as measured in the direction of its movement into the developer solution), a width of 40 cm, and a sheet thickness of 0.0254 cm was fed forwardly into an R-3 Ektachrome developer solution, also from Eastman Kodak. The paper feed rate was approximately 12 cm/min. The volume of developer solution within the reservoir 36 was maintained between about 70 and about 100 cc. Flow of the developer solution to the reservoir during the development of the PSM was adjusted to between about 10 and about 50 cc/min. The narrow dimension of the reservoir was 11 cm, its long dimension was 43 cm and the vertical distance between the inner surface 51 of the top housing section 32 and the inner surface 43 of the bottom housing section 34 was approximately 0.3 cm. The unsupported length of each finger 90 was 0.635 cm and the leg 110 of the blade 106 depended 1.5 cm from the surface 51 and was inclined at an angle "A" of about 15 degrees when not in contact with the PSM. The image developed on the PSM was of superior quality as compared to the same PSM processed employing the prior art "tank" techniques.

What is claimed:

1. Apparatus for use in the processing of a flexible PSM having a photographic emulsion on at least one of the flat surfaces thereon and employing a minimum of processing solution comprising reservoir means having an internal cavity which is relatively thin in comparison to its length and width and a quantity of processing solution contained within the reservoir cavity so that the processing solution contained therein assumes the form of a substantially sheet-like body and defines a linear face, said linear face having a generally rectangular geometry in plan view, the vertical thickness dimension of said linear face being slightly greater than the thickness dimension of said PSM, but not of a thickness greater than that at which the processing solution will flow outwardly from said reservoir when no PSM is disposed therein, means for feeding said PSM into and through said reservoir, said PSM initially entering said reservoir through said linear face of said processing solution, means for replenishing the processing solution contained within the reservoir as required, means including a plurality of fingers arranged in a single line extending across the path of forward movement of said PSM through said reservoir, sand fingers being positioned adjacent said linear face for contacting said emulsion-bearing surface of said PSM substantially immediately upon said PSM entering said processing solution and effectively distributing said processing solution over said surface, the feeding means adapted to feed said PSM through the reservoir at a controlled rate so that the processing solution distributed over said surface is retained on said surface for a period of time sufficient for said solution to react with said emulsion and render the same susceptible to the flow onto and retention of said solution on said surface.

2. The apparatus of claim 1 and including within said reservoir and downstream of said fingers, means for removing substantially all processing solution from said emulsion-bearing surface.

3. The apparatus of claim 2 wherein said means for removing said solution comprises a yieldable blade disposed across the path of forward movement of said PSM through said reservoir.

4. The apparatus of claim 1 and including within said reservoir and downstream of said fingers, at least one woven fabric loop means disposed across the path of forward movement of said PSM through said reservoir, said loop means carrying processing solution therein and including protrusions on a surface thereof in engagement with said forwardly moving PSM whereby there is effected an exchange of relatively depleted processing solution for relatively less-depleted process solution at said emulsion-bearing surface of said PSM.

5. The apparatus of claim 3 and including at least one further blade member disposed within said reservoir and downstream of the first blade.

* * * * *

UNITED STATES PATENT AND TRADEMARK OFFICE

CERTIFICATE OF CORRECTION

PATENT NO. : 5,266,994

DATED : November 30, 1993

INVENTOR(S) : Basavaraj R. Desai and Phillip A. Tarbell

It is certified that error appears in the above-identified patent and that said Letters Patent is hereby corrected as shown below:

Column 10, line 60, after partially insert -- disassembled, --.

Column 16, line 61, delete "sand" and insert -- said --.

Signed and Sealed this

Seventh Day of June, 1994

Bruce Lehman

*Attest:*

BRUCE LEHMAN

*Attesting Officer*

*Commissioner of Patents and Trademarks*